US008413713B2

(12) United States Patent
Huang

(10) Patent No.: US 8,413,713 B2
(45) Date of Patent: Apr. 9, 2013

(54) HEAT SINK MODULE WITH FINS HAVING Z SHAPED FOOT PORTIONS

(76) Inventor: Tsung-Hsien Huang, I-Lan Hsien (TW)

( * ) Notice: Subject to any disclaimer, the term of this patent is extended or adjusted under 35 U.S.C. 154(b) by 434 days.

(21) Appl. No.: 12/789,454

(22) Filed: May 27, 2010

(65) Prior Publication Data

US 2011/0290467 A1 Dec. 1, 2011

(51) Int. Cl.
*F28F 7/00* (2006.01)
*F28D 15/00* (2006.01)
*H05K 7/20* (2006.01)

(52) U.S. Cl.
USPC ..... 165/80.3; 165/104.23; 361/700

(58) Field of Classification Search ..... 165/104.33, 165/80.3; 361/700
See application file for complete search history.

(56) References Cited

U.S. PATENT DOCUMENTS

| | | | | |
|---|---|---|---|---|
| 851,977 | A * | 4/1907 | Bigsby | 165/183 |
| 6,742,581 | B2 * | 6/2004 | Mochizuki et al. | 165/185 |
| 2005/0211416 | A1 * | 9/2005 | Kawabata et al. | 165/80.3 |
| 2008/0060793 | A1 * | 3/2008 | Huang | 165/104.33 |
| 2009/0032221 | A1 * | 2/2009 | Huang | 165/80.3 |
| 2009/0046464 | A1 * | 2/2009 | Liu et al. | 362/294 |
| 2009/0194255 | A1 * | 8/2009 | Huang | 165/80.3 |

* cited by examiner

*Primary Examiner* — Brandon M Rosati
(74) *Attorney, Agent, or Firm* — Pai Patent & Trademark Law Firm; Chao-Chang David Pai

(57) ABSTRACT

A heat sink includes a base member having stepped channels spaced on the surface thereof in a parallel manner and first and second ribs protruding from the surface and respectively extending along two opposite lateral sides of each of the stepped channels, and radiation fins respectively mounted in the channels of the metal base member and supported on the second ribs vertically, each radiation fin having a Z-shaped foot portion that is inserted into one respective stepped channel of the base member and secured thereto by the associated first and second rib that are stamped to clamp on the Z-shaped foot portion of the associated radiation fin after its insertion into the respective stepped channel.

8 Claims, 5 Drawing Sheets

HEAT SINK MODULE WITH FINS HAVING Z SHAPED FOOT PORTIONS

BACKGROUND OF THE INVENTION (a) Field of the Invention

The present invention relates to heat sink modules and more particularly to such a heat sink module which has the ribs of the metal base member stamped after insertion of Z-shaped foot portions of the radiation fins into respective stepped channels of the metal base member, assuring engagement tightness.

(b) Description of the Prior Art

Many conventional heat sinks have channels located on the bottom wall of a metal base member for the mounting of radiation fins. A similar design is disclosed in U.S. Pat. No. 6,571,859 in which plate-like cooling ribs projecting from a base plate at intervals and approximately parallel to each other, protrude with a connection strip into the base plate in which they are cast. U.S. Pat. No. 5,014,776 discloses a heat emitting unit in which a number of parallel, flat ribs are attached to at least one side of the main body and projecting from the main body. The ribs are pressed into place through deformation of the intermediary ridges after the ribs are inserted into channels on the main body.

Employing a soldering technique to bond radiation fins to a base member with a solder paste is not environmentally friendly. Further, the aforesaid prior art design simply has the parallel, flat ribs pressed into place through deformation of the intermediary ridges after the ribs are inserted into channels on the main body. This method simply provides a two-point clamping force to secure each flat rib to the associated channel. If the parallel, flat ribs are not accurately inserted into the channels or a vibration occurs when the parallel, flat ribs are pressed into place through deformation of the intermediary ridges after insertion into the channels, the flat ribs may not be all kept in close contact with the bottom edges of the channels to have an equal height. If the flat ribs do not have an equal height after installation, the heat emitting unit will be regarded as a defective product, and the flat ribs may vibrate or come loose from the main body.

U.S. patent application Ser. No. 12/480,461, filed by the present inventor on Jun. 8, 2009 (with priority date Apr. 17, 2009) discloses a heat sink design in which the metal base member has parallel channels located on the top wall, first ribs protruding from the top wall and respectively extending along one side of each channel and second ribs protruding from the top wall and respectively extending along the other side of each channel, and radiation fins respectively mounted in the channels of the metal base member and supported on the second ribs vertically; each radiation fin has an angled foot portion, which is inserted into one channel and secured thereto by the associated first rib upon deformation of the associated first rib by an external force. However, the channels of this prior art design are plain channels, and the insertion depth of the angled foot portions of the radiation fins is limited. In consequence, the contact area between the angled foot portions of the radiation fins and the metal base panel is limited. Further, because the first ribs simply give a downward pressure to the angled foot portions of the radiation fins when deformed, the engagement between the deformed first ribs and the angled foot portions of the radiation fins may not be tight enough. Therefore, improvement in these regards is necessary.

SUMMARY OF THE INVENTION

The present invention has been accomplished under the circumstances in view. A heat sink module according to the present invention comprises a base member, and a plurality of radiation fins fastened to the base member. The base member comprises a plurality of stepped channels located on a surface thereof and arranged in parallel, a plurality of first ribs protruding from the surface and extending along one side of each of the stepped channels and a plurality of second ribs protruding from the surface and extending along an opposite side of each of the stepped channels. The radiation fins are respectively fastened to the stepped channels of the base member. Each radiation fin has its bottom end terminating in a Z-shaped foot portion. The Z-shaped foot portions of the radiation fins are respectively inserted into the stepped channels of the base member and secured thereto by the first ribs and second ribs of the base member that are stamped to clamp the Z-shaped foot portions of the radiation fins after the Z-shaped foot portions of the radiation fins are inserted into the stepped channels.

Further, the Z-shaped foot portion of each radiation fin comprises a base portion and a step. Each first rib of the base member is curved after the Z-shaped foot portions of the radiation fins are inserted into the respective stepped channels of the base member, forming a horizontal press portion, which is pressed on the step of the Z-shaped foot portion of the associated radiation fin, and a vertical press portion, which is pressed on the base portion of the Z-shaped foot portion of the associated radiation fin.

Further, the second ribs of the base member are respectively stopped against the back side of the base of each of the Z-shaped foot portions of the radiation fins to support the base of each of the Z-shaped foot portions of the radiation fins in shape when the first ribs are curved during stamping.

Further, the first ribs and the second ribs are kept in flush before stamping.

Further, the base member can be made in the form of a rectangular block member, a hollow cylindrical metal member, or a solid metal cylinder.

Further, heat pipes may be tightly fitted into the base member and the radiation fins for transferring waste heat from the base member to the radiation fins. Further, after having been tightly fitted into the base member, the hot ends of the heat pipes can be kept in flush with the bottom wall of the base member.

DETAILED DESCRIPTION OF THE PREFERRED EMBODIMENTS

Figure 1:
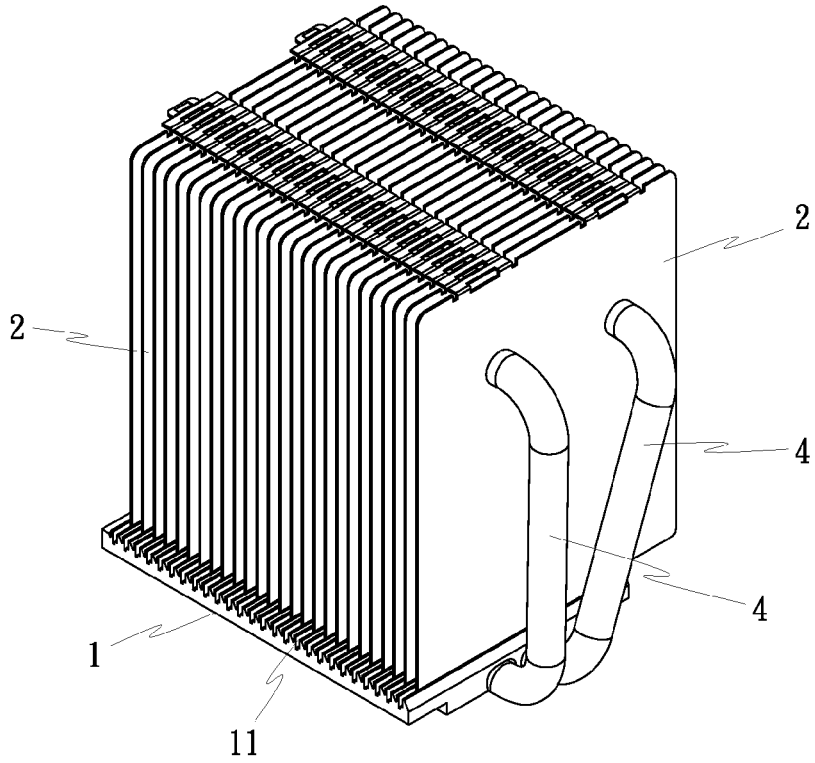
FIG. 1 is an oblique elevational view of a heat sink module in accordance with a first embodiment of the present invention.
Figure 2:
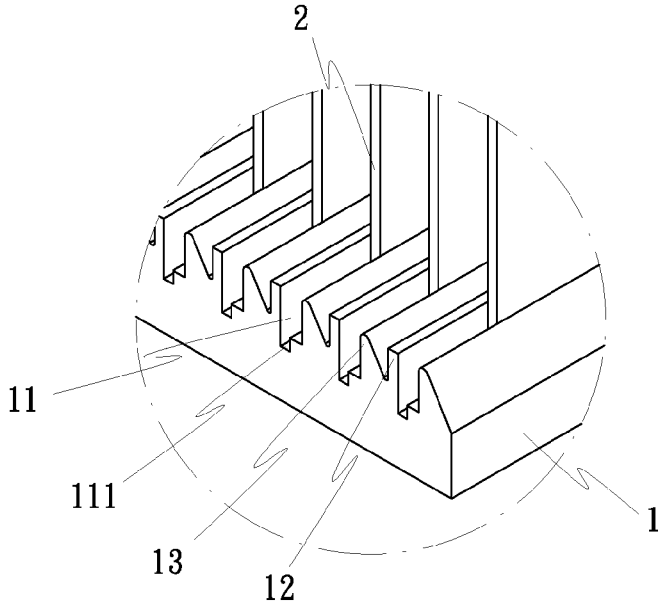
FIG. 2 is an enlarged view of a part of the heat sink module in accordance with the present invention, showing the Z-shaped foot portions of the metal radiation fins respectively inserted into the stepped channels of the metal base member before stamping.

As shown in FIGS. 1 and 2, a heat sink module in accordance with the present invention comprises a metal base member 1 and a number of metal radiation fins 2.

The metal base member 1 has stepped channels 11 located on the top wall in a parallel manner, a plurality of first ribs 12 protruding from the top wall and respectively extending along one side of each of the stepped channels 11 and a plurality of second ribs 13 protruding from the top wall and respectively extending along the other side of each of the stepped channels 11. The first ribs 12 and the second ribs 13 are in flush with each other.

Figure 3:
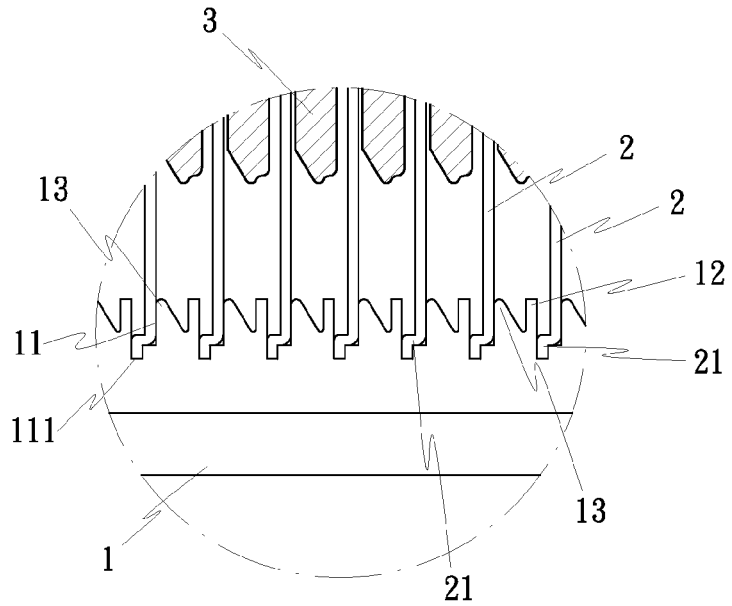
FIG. 3 is a schematic drawing of the present invention, showing stamping dies set into position before stamping.
Figure 4:
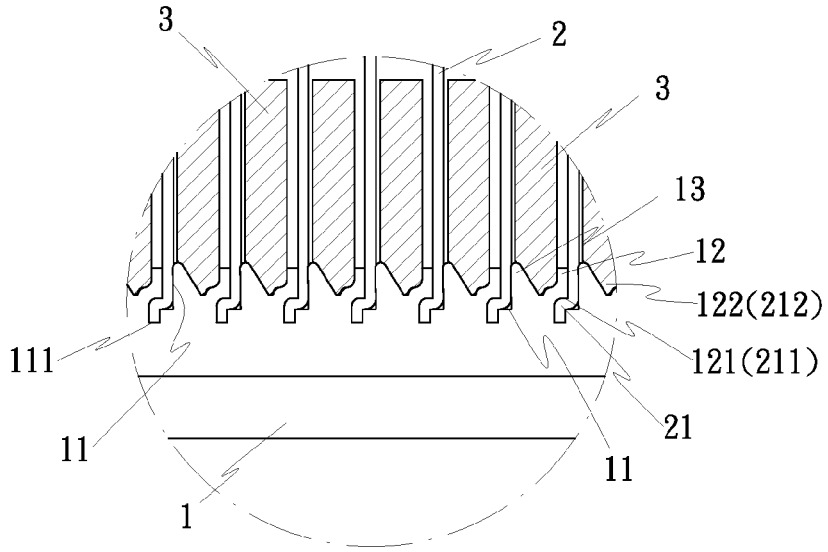
FIG. 4 corresponds to FIG. 3, showing the stamping dies stamped against the first and second ribs of the metal base member.
Figure 5:
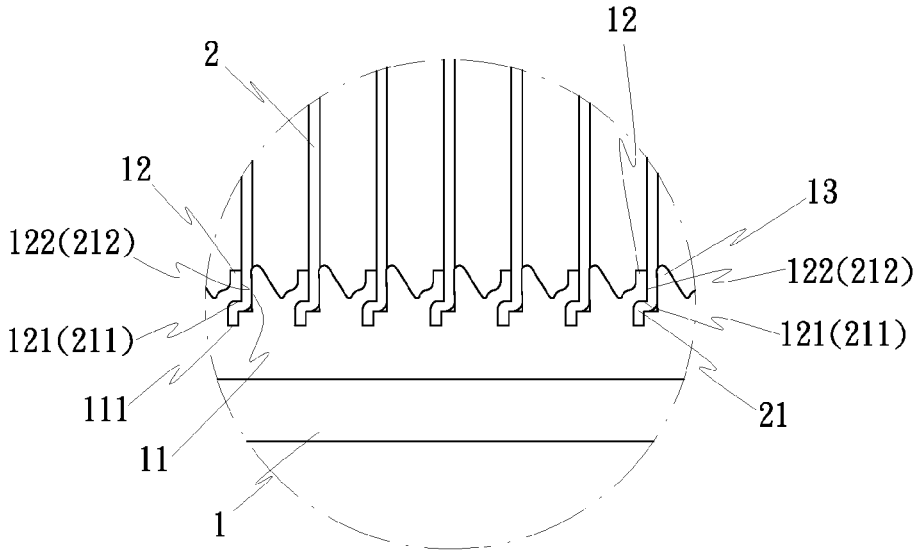
FIG. 5 is an enlarged view of a part of the heat sink module in accordance with the present invention, showing the first and second ribs forced into engagement with the Z-shaped foot portions of the metal radiation fins in the stepped channels of the metal base member after stamping.

Each radiation fin 2 has a bottom end terminating in a Z-shaped foot portion 21. The Z-shaped foot portions 21 of the metal radiation fins 2 are to be respectively inserted into the channels 11 of the metal base member 1, and then stamping dies 3 of a stamping machine are operated to stamp the first ribs 12 and second ribs 13 of the metal base member 1 (see FIG. 3), deforming the first ribs 12 and causing the first ribs 12 to exert downward and lateral pressure to the Z-shaped foot portion 21 of the metal radiation fins 2 against the bottom surfaces 111 of the stepped channels 11 (see FIG. 4), thus the first ribs 12 and the second ribs 13 are firmly clamped on the metal radiation fins 2 to hold the Z-shaped foot portions 21 of the metal radiation fins 2 in close and tight contact with the bottom surfaces 111 of the stepped channels 11 (see FIGS. 5 and 6), increasing the contact area between the metal radiation fins 2 and the metal base member 1 and enhancing heat conductivity.

More specifically, each first rib 12, when stamped, is curved, forming a horizontal press portion 121, which is pressed on the step 211 of the Z-shaped foot portion 21 of the associated radiation fin 2, and a vertical press portion 122, which is pressed on the base 212 of the Z-shaped foot portion 21 of the associated radiation fin 2. The stamping dies 3 are respectively stamped against the first ribs 12 and the second ribs 13 in such a manner that the second ribs 13 are respectively stopped against the back side of the base 212 of the Z-shaped foot portions 21 of the associated radiation fins 2 to support the base 212 of the Z-shaped foot portions 21 of the metal radiation fins 2 in shape when the first ribs 12 are deformed, preventing curving of the base 212 of the Z-shaped foot portions 21 of the associated radiation fin 2.

Figure 6:
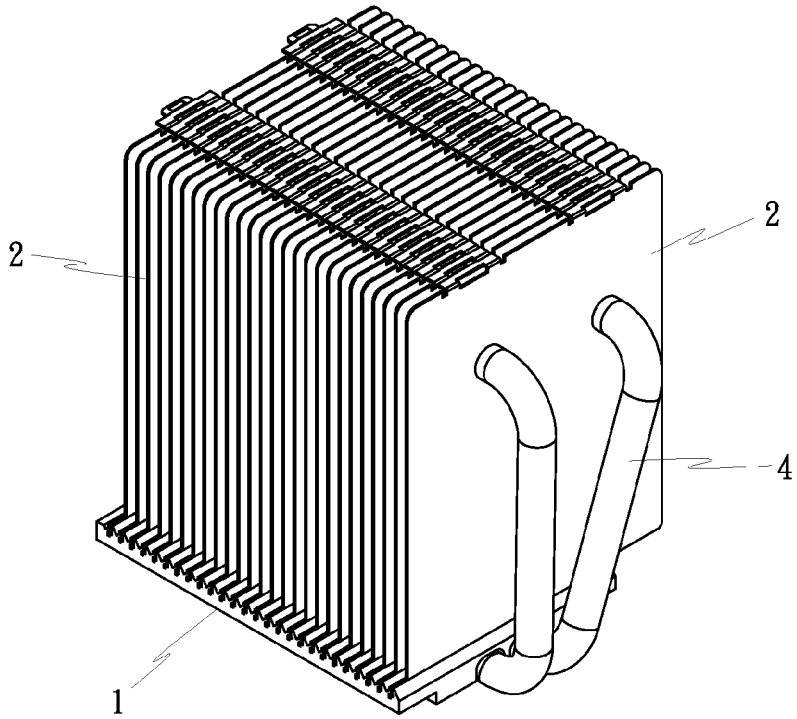
FIG. 6 is an oblique elevational view of the finished heat sink module in accordance with the present invention.

Referring to FIG. 6 and FIG. 1 again, heat pipes 4 may be fitted into the metal radiation fins 2 and the metal base member 1 for quick transfer of waste heat from the metal base member 1 to the metal radiation fins 2 for quick dissipation into the open air. Further, after installation of the heat pipes 4, one end, namely, the hot end of each heat pipe 4 is exposed to the outside of the metal base member 1 and kept in flush with the bottom wall of the metal base member 1. Alternatively, the hot end of each heat pipe 4 can be embedded in the metal base member 1 and kept from sight.

Figure 7:
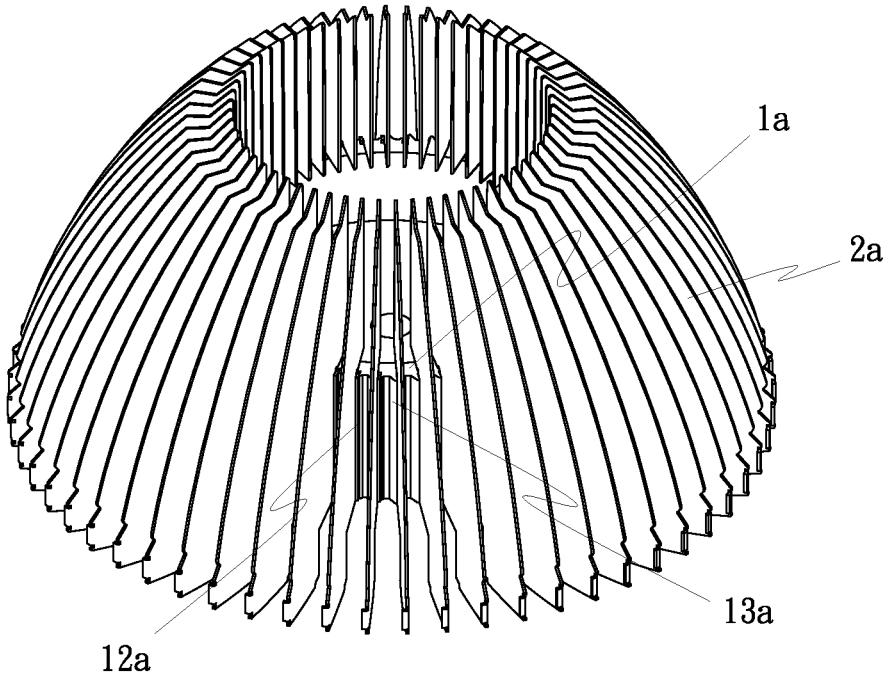
FIG. 7 is an oblique elevational view of an alternate form of the heat sink module in accordance with the present invention.
Figure 8:
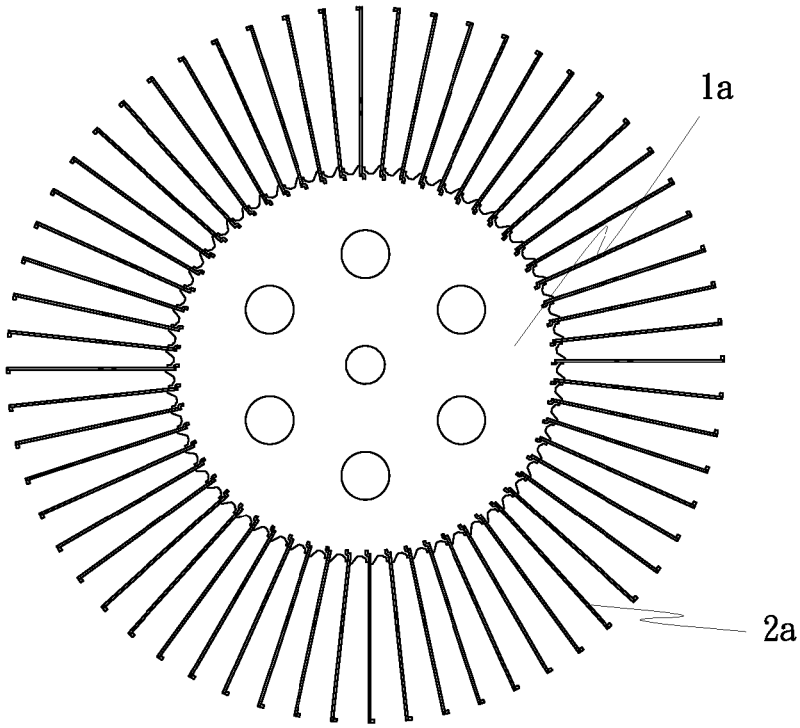
FIG. 8 is a bottom view of the heat sink module shown in FIG. 7.
Figure 9:
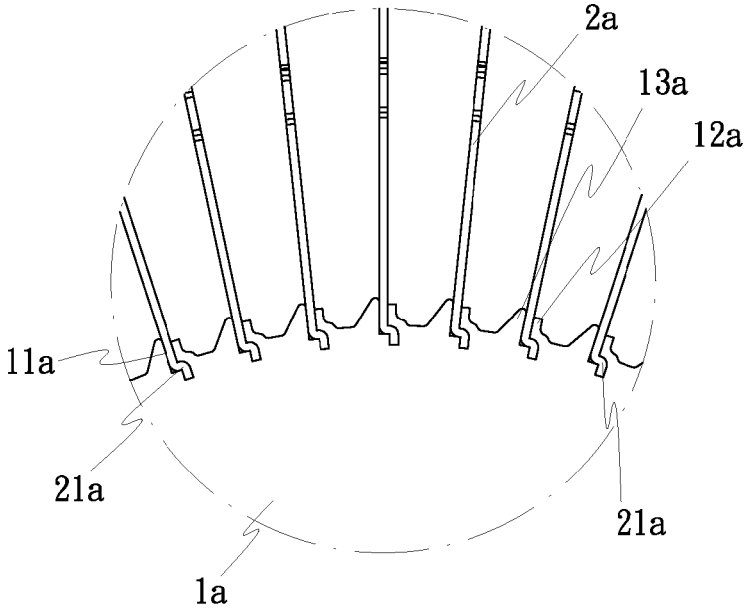
FIG. 9 is an enlarged view of a part of FIG. 8, showing the engaged arrangement between the Z-shaped foot portions of the metal radiation fins and the ribs of the metal base member.

FIGS. 7~9 show an alternate form of the present invention. According to this alternate form, the heat sink module comprises a cylindrical metal base member la (either in solid or hollow structure) and a number of radiation fins 2*a*. The metal base member 1*a* has stepped channels 11*a* spaced around the periphery in a parallel manner, a plurality of first ribs 12*a* protruding from the periphery and respectively extending along one side of each of the stepped channels 11*a* and a plurality of second ribs 13*a* protruding from the periphery and respectively extending along the other side of each of the stepped channels 11*a*. Each radiation fin 2*a* has a bottom end terminating in a Z-shaped foot portion 21*a*. The Z-shaped foot portions 21*a* of the metal radiation fins 2*a* are to be respectively inserted into the channels 11*a* of the metal base member 1*a*, and then stamping dies of a stamping machine (not shown) are operated to stamp the first ribs 12*a* and second ribs 13*a* of the metal base member 1*a*, deforming the first ribs 12*a* and causing the first ribs 12*a* to exert downward and lateral pressure to the Z-shaped foot portion 21*a* of the metal radiation fins 2*a* against the bottom surfaces of the stepped channels 11*a*, thus the first ribs 12*a* and the second ribs 13*a* are firmly clamped on the metal radiation fins 2*a* to hold the Z-shaped foot portions 21*a* of the metal radiation fins 2*a* in tight contact with the bottom surfaces of the stepped channels 11*a*, increasing the contact area between the metal radiation fins 2*a* and the metal base member la and enhancing heat conductivity.

A prototype of heat sink module has been constructed with the features of FIGS. 1~9. The heat sink module functions smoothly and effectively to provide all of the features disclosed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A heat sink, comprising:

a base member, said base member having a plurality of stepped channels located on a top side thereof and arranged in parallel, wherein a bottom surface is formed at a lowest level of each stepped channel and a step surface is formed at a level higher than the bottom surface in each stepped channel, both the bottom surface and the step surface facing up; a plurality of first ribs protruding from said bottom surface and extending along one side of said stepped channels respectively; and a plurality of second ribs protruding from said step surface and extending along an opposite side of said stepped channels respectively; and a plurality of radiation fins respectively fastened to said stepped channels of said base member, each said radiation fin having a bottom end terminating in a Z-shaped foot portion having a profile matching that of the stepped channels, the Z-shaped foot portions of said radiation fins being respectively inserted into said stepped channels and secured thereto by the first ribs and second ribs of said base member that are stamped to clamp the Z-shaped foot portions of said radiation fins after insertion of the Z-shaped foot portions of said radiation fins into said stepped channels.

2. The heat sink module as claimed in claim 1, wherein the Z-shaped foot portion of each said radiation fin comprises a base portion and a step; each first rib of said base member is curved, forming a horizontal press portion, which is pressed on the step of the Z-shaped foot portion of the associated radiation fin, and a vertical press portion, which is pressed on the base portion of the Z-shaped foot portion of the associated radiation fin.

3. The heat sink module as claimed in claim 2, wherein said second ribs of said base member are respectively stopped against a back side of the base of the Z-shaped foot portions of said radiation fins to support the base of the Z-shaped foot portions of said radiation fins in shape when said first ribs are curved during stamping.

4. The heat sink module as claimed in claim 1, wherein said first ribs and said second ribs are in flush with each other.

5. The heat sink module as claimed in claim 1, further comprising at least one heat pipe tightly fitted into said base member and said radiation fins for transferring waste heat from said base member to said radiation fins, each said heat pipe having one end thereof tightly fitted into said base member and kept in flush with a bottom wall of said base member.

6. The heat sink module as claimed in claim 1, wherein said base member is a rectangular block member.

7. The heat sink module as claimed in claim 1, wherein said base member is a hollow cylindrical metal member.

8. The heat sink module as claimed in claim 1, wherein said base member is a solid metal cylinder.

* * * * *